United States Patent [19]

Shimizu

[11] Patent Number: 4,614,155

[45] Date of Patent: Sep. 30, 1986

[54] MECHANISM FOR ADJUSTING THE VERTICAL POSITION OF A FORMAT ON A PRINTER

[75] Inventor: Shigeru Shimizu, Takarazuka, Japan

[73] Assignee: Hamada Printing Press Mfg. Co., Ltd., Osaka, Japan

[21] Appl. No.: 799,731

[22] Filed: Nov. 19, 1985

[30] Foreign Application Priority Data

Nov. 22, 1984 [JP] Japan ..... 59-178377

[51] Int. Cl.[4] ..... B41F 13/24

[52] U.S. Cl. ..... 101/248

[58] Field of Search ..... 101/248, 216–217, 101/348–350, 132, 141

[56] References Cited

U.S. PATENT DOCUMENTS

| | | | |
|---|---|---|---|
| 3,209,684 | 10/1965 | Blochl | 101/248 |
| 3,326,439 | 6/1967 | Sarka | 101/216 |
| 3,440,958 | 4/1969 | Benda et al. | 101/349 |
| 3,793,899 | 2/1974 | Bourbonnaud | 101/248 |
| 4,037,531 | 7/1977 | Ritzerfeld | 101/141 |
| 4,085,674 | 4/1978 | Biggar, III | 101/248 |
| 4,488,484 | 12/1984 | Jiruse et al. | 101/248 |
| 4,520,728 | 6/1985 | Ecker et al. | 101/248 |
| 4,563,951 | 1/1986 | Mathes et al. | 101/216 |

*Primary Examiner*—E. H. Eickholt

*Attorney, Agent, or Firm*—Wenderoth, Lind & Ponack

[57] ABSTRACT

A mechanism for adjusting the vertical position of a format on a printing press is proposed which makes use of the rotation of a blanket cylinder. A pair of pawls engage and disengage with a pair of ratchet wheels, which turn when a pawl support plate turns by a preset angle with respect to the blanket cylinder. The rotation of the ratchet wheel is transmitted to the format cylinder, so that the vertical position of a format is adjusted.

2 Claims, 9 Drawing Figures

MECHANISM FOR ADJUSTING THE VERTICAL POSITION OF A FORMAT ON A PRINTER

This invention relates to a mechanism for adjusting the vertical position of a format on a printing press.

FIG. 8 shows a conventional perfecting printing press. Format cylinders 83, 84 are in contact with a pair of blanket cylinders 80, 81 disposed one upon the other, and sheet gripping pawls 86 are attached to a chain delivery 85 passing around a chain wheel provided on the upper blanket cylinder 80. The end of the sheet S fed from a paper feed unit 87 is held by the gripping pawls 86, and both sides of the sheet are printed by passing it between the pair of blanket cylinders 80, 81.

When printing with various types of printing presses including the abovesaid type, after a format has been set on the format cylinder, the position of the format is adjusted. This adjustment includes vertical position adjustment (adjustment in a peripheral direction), lateral position adjustment, and twist adjustment. In the first one, the format cylinder is turned to change the phase with respect to the blanket cylinder.

As one of conventional vertical position adjusting devices, a mechanism for operating a format cylinder driving unit by means of a motor is known as disclosed in Japanese Unexamined Patent Publication No. 59-123665. With such a conventional mechanism the printing press becomes bulky, going against the trend toward compact printing presses, and the cost is high.

It is an object of the present invention to provide a compact and economical mechanism which eliminates the abovesaid shortcomings and which can adjust the vertical position of a format by making use of rotation of the blanklet cylinder.

In accordance with the present invention, there is provided a mechanism for adjusting the vertical position of a format on a printing press having a blanket cylinder and a format cylinder, the mechanism comprising: a blanket shaft of the blanket cylinder rotatably supported; a phase adjusting gear rotatably mounted on the blanket shaft; a gear mounted on the format cylinder and engaging the phase adjusting gear; a gear support plate fixedly mounted on the blanket shaft so as to rotate together with the blanket shaft and having a tubular part; a pair of ratchet wheels rotatably mounted on the tubular part of the gear support plate and coupled together and each having gears facing in opposite directions to each other; a pawl support plate rotatably mounted on the tubular part of the gear support plate; a pair of pawls having their middle portion pivotally supported on the pawl support plate and adapted to engage the pair of ratchet wheels; gear transmissions means supported on the pawl support plate for transmitting the rotation of the ratchet wheels to the phase adjusting gear; a pawl biassing plate formed with a circular hole and pivotally mounted on a stationary portion of the printing press; spring means for biassing the pawls against the inner wall of the circular hole formed in the pawl biassing plate; a pair of solenoids for biassing the pawl biassing plate in one of two directions; and means for converting the rotation of the blanket shaft to cause the pawl support plate to turn in alternate directions by a preset angle.

In the vertical position adjusting mechanism of the present invention, when one of a pair of solenoids is actuated to bias the pawl biassing plate, the circular hole formed in the pawl biassing plate becomes eccentric with respect to the center of the blanket shaft. Therefore, as the blanket shaft is rotated, the pair of pawls each having a roller at its end guided by the inner wall of the circular hole engages and disengages with and from the corresponding ratchet wheels.

On the other hand, as the blanket shaft rotates, the parts mounted thereon rotate together with the shaft. While they are rotating, the pawl support plates are turned alternately in the normal and reverse directions by a preset angle with respect to the blanket shaft by the action of a rotary motion converting mechanism.

Thus, when the blanket shaft is rotated with the pawl support plate biassed in one direction, a pair of pawls engage the respective ratchet wheels and the pawl support plate turns at a preset angle in one direction with respect to the blanket shaft. Thus, the ratchet wheel turns in one direction and its rotation is transmitted to the phase adjusting gear through a gear transmission, so that the gear on the format cylinder engaging the phase adjusting gear turns to adjust the vertical position of a format set on the format cylinder.

Other features and objects of the present invention will become apparent from the following description taken with reference to the accompanying drawings, in which.

Figure 1:
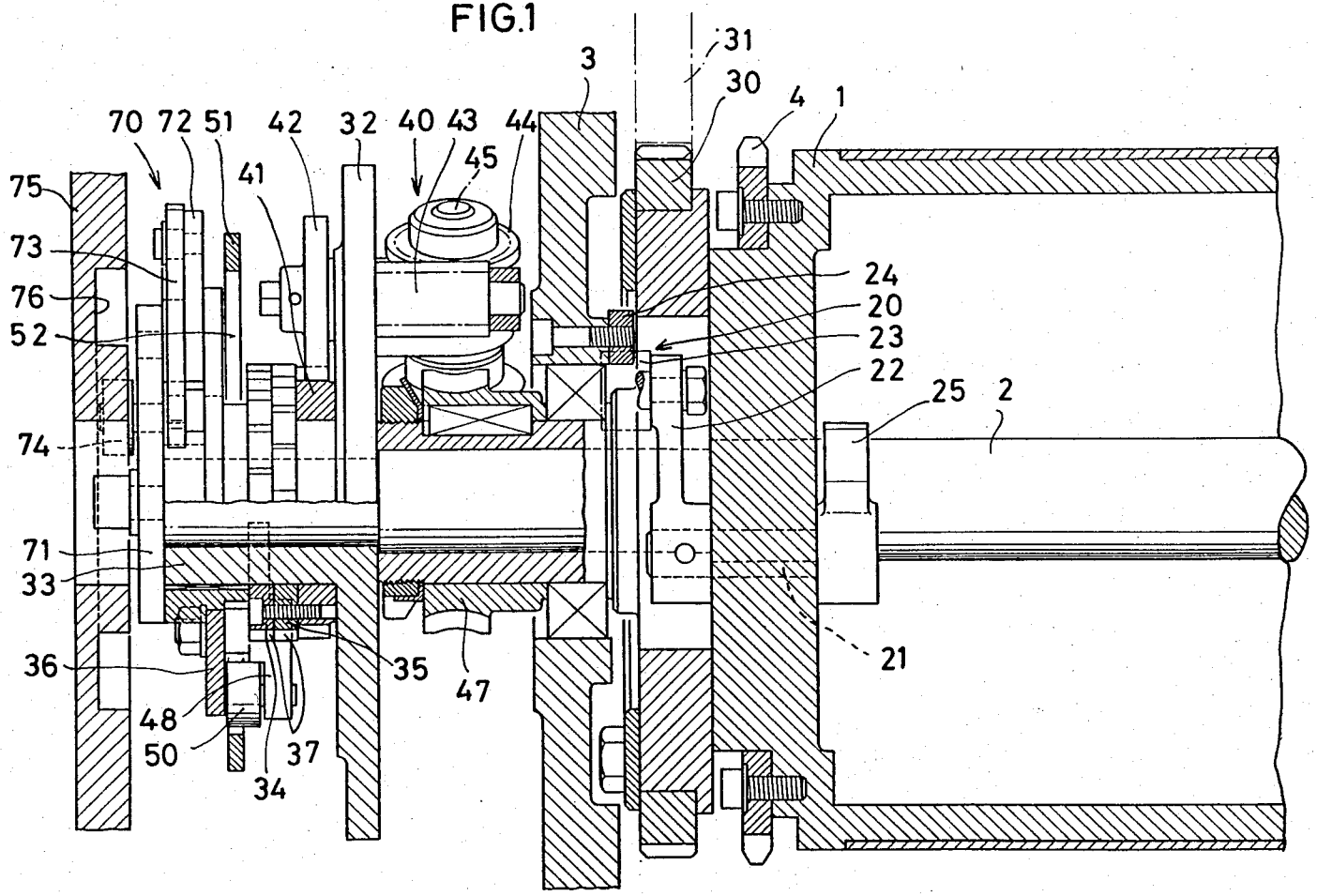
FIG. 1 is a horizontal sectional plan view of the mechanism embodying the present invention.
Figure 2:
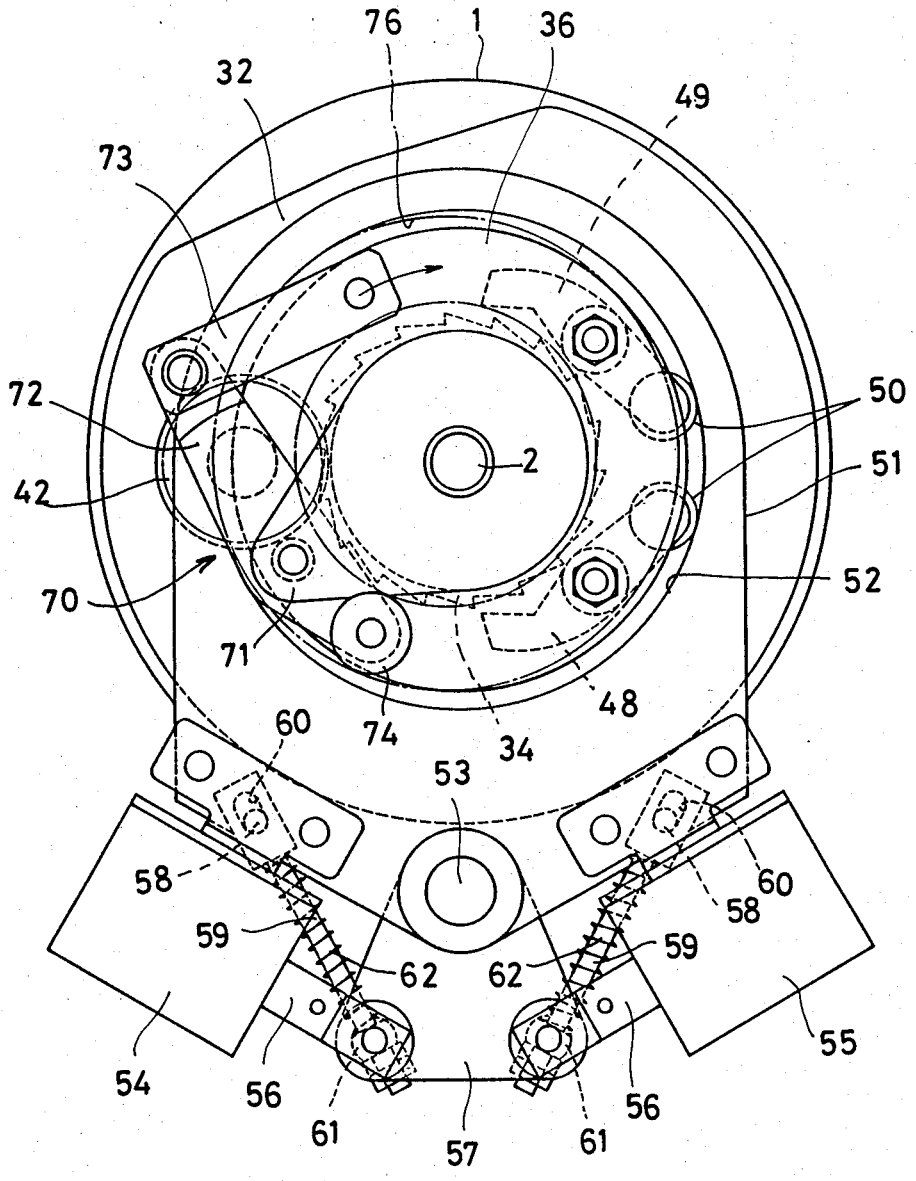
FIG. 2 is a side view thereof.
Figure 6:
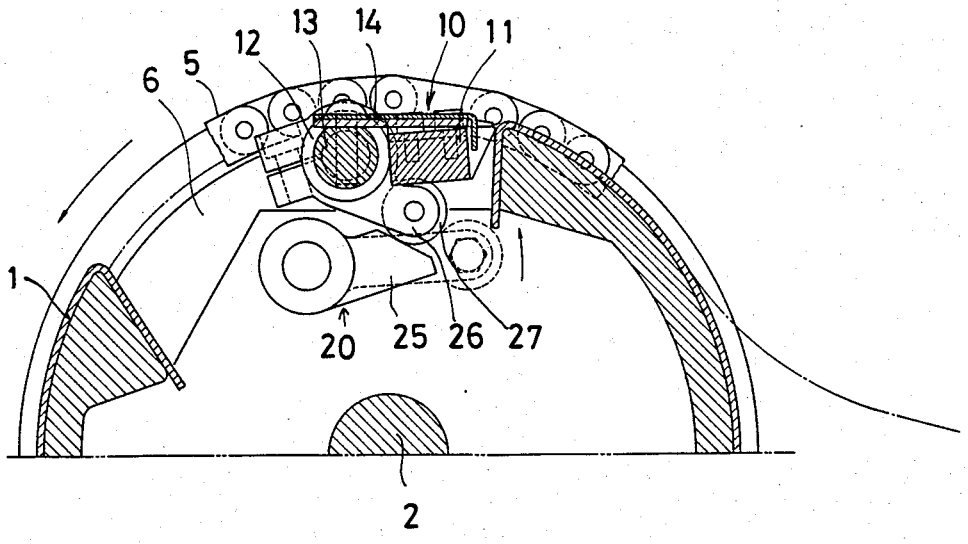
FIG. 6 is a sectional view of the above said mechanism showing the clamping pawls.
Figure 7:
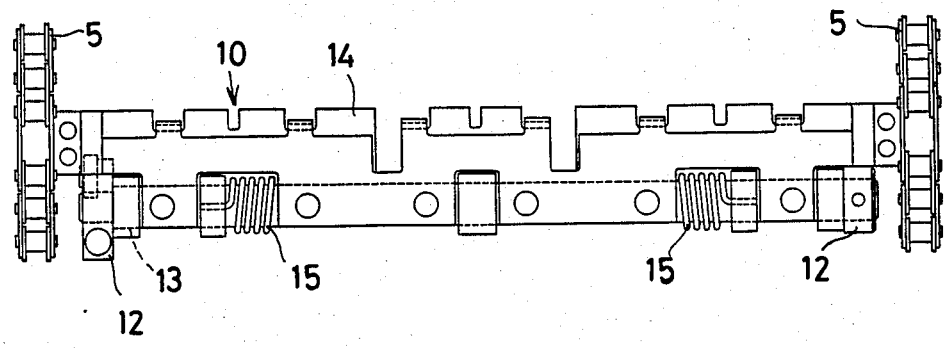
FIG. 7 is a plan view showing the clamping pawls.

As shown in FIGS. 1 and 2, a blanket shaft 2 of a blanket cylinder 1 is rotatably supported on a side frame 3, and a sprocket wheel 4 is secured to each end of the blanket cylinder 1. A format gripping mechanism 10 is provided, as shown in FIGS. 6 and 7, across a pair of endless chains 5 passing around the sprocket wheels 4. The mechanism 10 is received in an opening 6 formed in part of the outer periphery of the blanket cylinder 1 as the endless chains 5 move.

This gripping mechanism 10 has support pieces 12 provided at both ends of an anvil 11 extending across the pair of endless chains 5. Gripping pawls 14 have one end affixed to a support shaft 13 extending from the support pieces 12. Each gripping pawl 14 turns around each support shaft 13 by means of a cam mechanism 20 (FIG. 1) provided at one end of the blanket cylider 1, so that their other end moves away from the anvil 11. When they are turned in the reverse direction by springs 15 mounted on the support shaft 13, their other end is pressed against the anvil 11.

The cam mechanism 20, as shown in FIGS. 1 and 6, has a shaft 21 rotatably mounted to extend through the end plate of the blanket cylinder 1. A roller 23 at the end of an arm 22 provided at one end of the shaft 21 is in contact with a pawl opening cam 24 mounted on the inner side of the side frame 3, while the end of an arm 25 provided at the other end of the shaft 21 is in contact with a roller 27 at an end of a roller arm 26 fixed to the end of the support shaft 13.

On the blanket shaft 2, as shown in FIG. 1, a phase adjusting gear 30 is rotatably mounted to be disposed between the blanket cylinder 1 and the side frame 3. When the gear 30 rotates, a format cylinder (83 in FIG. 8) rotates together with a format cylinder gear 31 engaging the gear 30, so that the vertical position of the format mounted on the format cylinder can be adjusted.

On the blanket shaft 2, a circular gear support plate 32 is fitted so as to rotate integrally with the blanket shaft 2. On the tubular part 33 of the gear support plate 32, a pair of mutually coupled ratchet wheels 34, 35, and a circular pawl support plate 36 are rotatably mounted.

Figure 3:
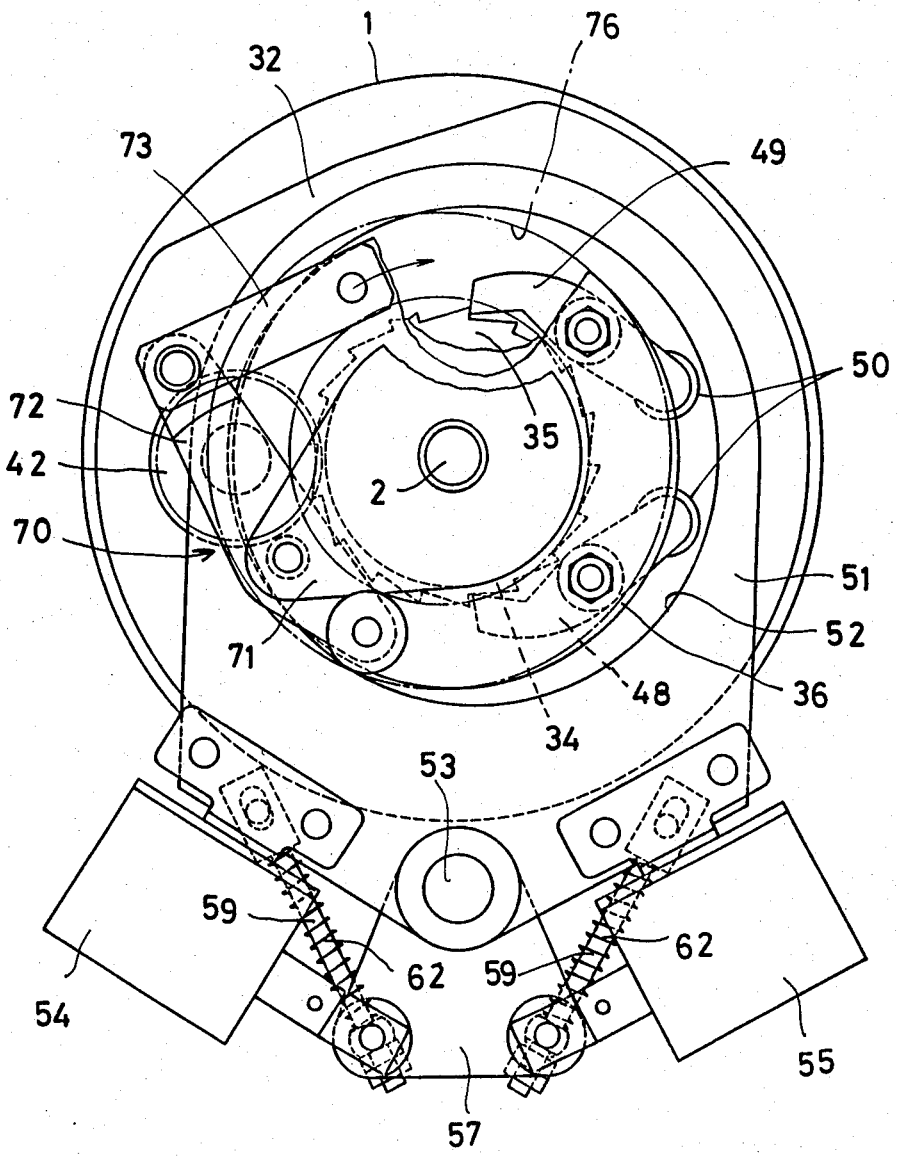
FIG. 3 is a partially cutaway side view thereof showing the operation.

The teeth 37 on the ratchet wheels 34, 35 are directed in opposite directions as shown in FIG. 3, and the rotation of the ratchet wheels 34, 35 with respect to the tubular part 33 is transmitted to the phase adjusting gear 30 through a gear transmission mechanism 40 supported on the gear support plate 32.

Figure 4:
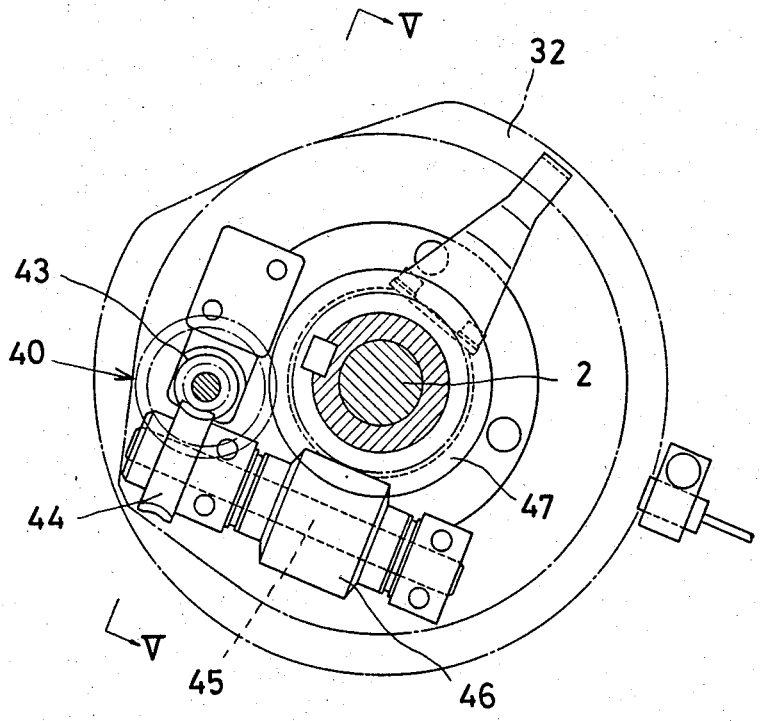
FIG. 4 is a side view thereof showing the gear transmission.
Figure 5:
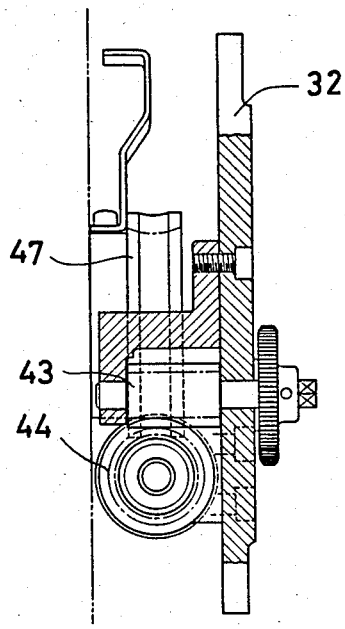
FIG. 5 is a sectional view taken along the line V—V of FIG. 4.

The gear transmission mechanism 40 has, as shown in FIGS. 1 and 4, a gear 41 fixed on the back of the ratchet wheel 35 and engaging a transmission gear 42 supported outside of the gear support plate 32. The rotation of the transmission gear 42 is transmitted to a transmission shaft 45 supported rotatably on the back of the gear support plate 32 through a worm 43 and a worm wheel 44, and the rotation of the transmission shaft 45 is transmitted to a worm wheel 47 mounted on the phase adjusting gear 30 from a worm 46 fixed to the shaft 45.

On the back of the pawl support plate 36, as shown in FIG. 2, the central parts of a pair of pawls 48, 49 adapted to engage and disengage with and from the ratchet wheels 34, 35 are pivotally supported. These pawls 48, 49 are biassed in one direction by springs (not shown) so that rollers 50 provided at one end thereof will be pressed against the inner wall of a circular hole 52 formed in the pawl biassing plate 51.

The lower part of the pawl biassing plate 51 is pivotally supported by a support shaft 53 extending from the side frame 3, and a pair of solenoids 54, 55 are mounted at both sides of the support shaft 53. Plungers 56 of the solenoids 54, 55 are coupled to a support piece 57 fixed to the support shaft 53.

At both sides of the support shaft 53, a pair of pins 58 are provided. Oval holes 60 formed at the one end of rods 59 receive these pins 58, while the other ends of the rods 59 are slidably supported by protrusions 61 rotatably fitted to the support piece 57. Springs 62 are fitted on the rods 59 to support the pawl biassing plate 51 so that its circular hole 52 will be concentric with respect to the center of the blanket shaft 2 with the pawls 48, 49 not engaging with the corresponding ratchet wheels 34, 35.

The pawl support plate 36 is turned in either direction at a preset angle by the action of a rotary motion converting mechanism 70 as the blanket shaft 2 rotates. The mechanism 70 has, as shown in FIGS. 1 and 2, a drive arm 71 mounted on the end of the blanket shaft 2. One end of a roller arm 72 having its middle portion linked to the end of the drive arm 71 and part of the outer periphery of the pawl support plate 36 are coupled together by a link 73, while a roller 74 fitted to the other end of the roller arm 72 is engaged in a circular cam groove 76 formed in a cam plate 75 disposed at one end of the blanket shaft 2.

The cam plate 75 is fixed in position, supported by the side frame 3 or the like, and the circular cam groove 76 in the cam plate 75 is eccentric with respect to the center of the blanket shaft 2.

In operation, when adjusting the vertical position of a format set on a format cylinder 83 (FIG. 8), one of the solenoids 54, 55 is energized depending on the direction of adjustment, and the blanket shaft 2 is put into rotation.

Suppose, the righthand one (55) of the pair of solenoids 54, 55 shown in FIG. 2 is energized to excite the plunger 56. The solenoid 55 tends to move with respect to the fixed plunger 56, so that the pawl biassing plate 51 turns about the support shaft 53 as shown in FIG. 3, causing its circular hole 52 to become eccentric with respect to the blanket shaft 2.

Although the rollers 50 of the pawls 48, 49 are normally in contact with the inner wall of the circular hole 52, when the pawl biassing plate 51 turns, the pawls 48, 49 will come away from the inner wall of the hole 52 and engage and disengage with the ratchet wheels 34, 35 as the pawl support plate 36 turns in alternate directions.

When the blanket shaft 2 rotates, the parts mounted thereon rotate together with it. During this rotation, the roller 74 of the roller arm 72 moves along the circular cam groove 76 which is eccentric with respect to the center of the blanket shaft 2. While rotating about the center of the blanket shaft 2, the roller arm 72 turns by a preset angle about the linking part to the drive arm 71. In consequence, with the rotation of the roller arm 72, while turning together with the blanket shaft 2, the pawl support plate 36 turns in one direction and the other by a preset angle with respect to the tubular part 33 of the gear support plate 32.

Now, one (55) of the solenoids 54, 55 is energized and the blanket shaft 2 is rotated in this state. With the pawl 48 engaging the corresponding ratchet wheel 34 and the other pawl not engaging, the pawl support plate 36 turns by a preset angle in the direction of arrow in FIG. 3 by the action of the rotary motion convertion mechanism 70, so that the ratchet wheel 34 turns. The rotation of the ratchet wheel 34 is transmitted to the phase adjusting gear 30 through the gear transmission mechanism 40. Thus the format cylinder gear 31 engaged therewith is turned, so that the format set on the format cylinder will be adjusted in a vertical or peripheral direction.

Since both the pawl support plate 36 and the ratchet wheels 34, 35 are rotatably mounted on the tubular part of the gear support plate 32, they rotate as the blanket shaft 2 rotates. Thus, even if one of the pawls 48, 49 engages the respective ratchet wheel, the latter will not turn with respect to the gear support plate unless the pawl support plate 36 turns with respect to it. The rotation of the ratchet wheel is transmitted to the format cylinder only while the pawl support plate 36 turns in one direction with respect to the gear support plate with one of the pawls engaging the associated ratchet wheel and the other not engaging it.

When the other solenoid 54 is energized while the blanket shaft 2 is rotating, the pawl biassing plate 51 is inclined in the reverse direction to above, and the pawl support plate 36 turns by a preset angle in the reverse direction to the direction shown in FIG. 3 with the pawl 49 engaging the ratchet wheel 35, and the ratchet wheel 35 turns reversely, so that the format on the format cylinder will be adjusted in the reverse direction.

Figure 9:
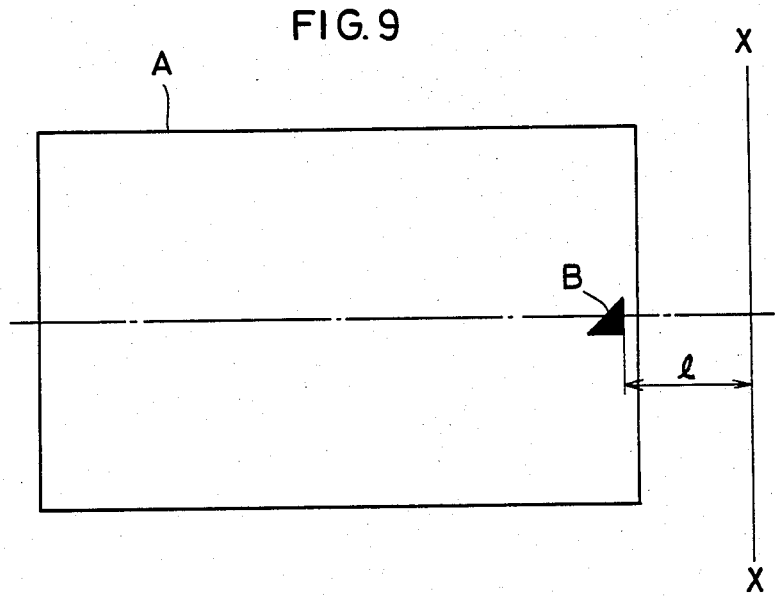
FIG. 9 is a view showing how automatic adjustment of the vertical position is made.

As shown in FIG. 9, by providing a register mark B at the end of the format A set on the format cylinder, measuring the distance l from the reference line X—X to the register mark B and comparing the measured value with a preset value, how much the format A has to be moved can be known.

Furthermore, the vertical position of the format can be adjusted automatically by providing a reference position detecting mechanism adjacent to any part rotating in synchronism with the format cylinder, counting the pulses by feeding the signal from this reference position detecting mechanism and the signal from a reference pulse generator into a counter, providing a detector for detecting the register mark B around the format cylinder, stopping the counting in response to a signal from this detector, feeding the signal from the counter and a preset signal from a setting device into a comparative arithmetic unit, and controlling the solenoids 54, 55 by use of the signal from the comparative arithmetic unit.

Figure 8:
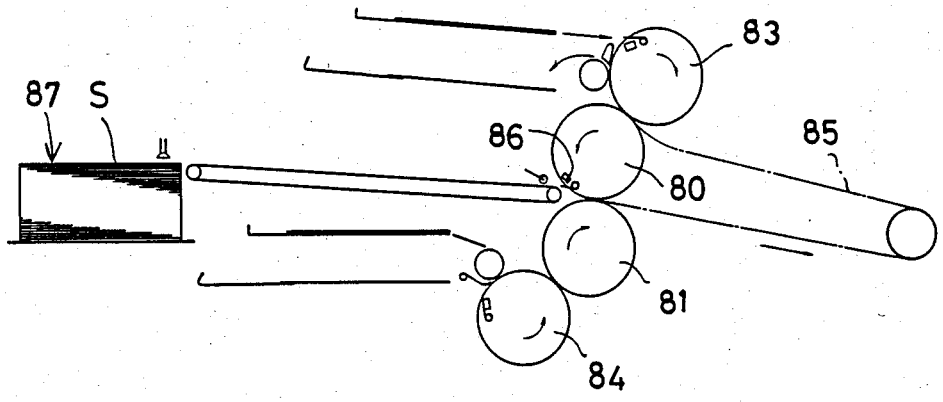
FIG. 8 is a schematic view of an example of a perfecting press.

Besides, the format on the lower format cylinder shown in FIG. 8 can be adjusted in the vertical position simultaneously, by providing the vertical position adjusting devices embodying this invention at both ends of the blanket cylinder.

What are claimed are:

1. A mechanism for adjusting the vertical position of a format on a printing press having a blanket cylinder and a format cylinder, said mechanism comprising:

a blanket shaft of the blanket cylinder rotatably supported;

a phase adjusting gear rotatably mounted on said blanket shaft;

a gear mounted on the format cylinder and engaging said phase adjusting gear;

a gear support plate fixedly mounted on said blanket shaft so as to rotate together with said blanket shaft and having a tubular part;

a pair of ratchet wheels rotatably mounted on said tubular part of said gear support plate and coupled together and each having gears facing in opposite directions to each other;

a pawl support plate rotatably mounted on said tubular part of said gear support plate;

a pair of pawls having their middle portion pivotally supported on said pawl support plate and adapted to engage said pair of ratchet wheels;

gear transmission means supported on said pawl support plate for transmitting the rotation of said ratchet wheels to said phase adjusting gear;

a pawl biassing plate formed with a circular hole and pivotally mounted on a stationary portion of the printing press;

spring means for biassing said pawls against the inner wall of said circular hole formed in said pawl biassing plate;

a pair of solenoids for biassing said pawl biassing plate in one of two directions; and means for converting the rotation of said blanket shaft to cause said pawl support plate to turn in alternate directions by a preset angle.

2. The mechanism as claimed in claim 1, wherein said rotation converting means comprise a drive arm fixedly mounted on said blanket shaft, a roller arm having its middle portion coupled to one end of said drive arm, a link coupling one end of said roller arm to a peripheral portion of said pawl support plate, and a roller provided at the other end of said roller arm and adapted to be guided by a stationary cam groove which is eccentric with respect to the center of said blanket shaft.

* * * * *